US011970909B2

(12) United States Patent
Püttmann

(10) Patent No.: US 11,970,909 B2
(45) Date of Patent: Apr. 30, 2024

(54) DRILL BIT OF A GROUND DRILLING DEVICE WITH AN ENLARGEMENT OF A RECEPTACLE FOR FASTENING AN ATTACHMENT THERETO AND METHOD FOR PRODUCING SAME

(71) Applicant: TRACTO-TECHNIK GmbH & Co. KG, Lennestadt (DE)

(72) Inventor: Franz-Josef Püttmann, Lennestadt (DE)

(73) Assignee: TRACTO-TECHNIK GmbH & Co. KG, Lennestadt (DE)

( * ) Notice: Subject to any disclaimer, the term of this patent is extended or adjusted under 35 U.S.C. 154(b) by 0 days.

(21) Appl. No.: 17/856,065

(22) Filed: Jul. 1, 2022

(65) Prior Publication Data

US 2023/0003087 A1 Jan. 5, 2023

(30) Foreign Application Priority Data

Jul. 5, 2021 (DE) ..... 10 2021 003 448.1

(51) Int. Cl.
*E21B 10/62* (2006.01)
*E21B 17/046* (2006.01)

(52) U.S. Cl.
CPC ..... *E21B 10/62* (2013.01); *E21B 17/0465* (2020.05)

(58) Field of Classification Search
CPC ..... E21B 7/26; E21B 4/06; E21B 4/08; E21B 4/10; E21B 4/12; E21B 4/14; E21B 4/145; E21B 11/02
See application file for complete search history.

(56) References Cited

U.S. PATENT DOCUMENTS

| | | | | |
|---|---|---|---|---|
| 4,100,979 | A | 7/1978 | Schmidt | |
| 5,788,430 | A * | 8/1998 | Meyen | B23B 51/0473 279/19.5 |
| 2002/0060095 | A1* | 5/2002 | Wentworth | E21B 17/046 175/398 |
| 2007/0228728 | A1* | 10/2007 | Webb | F16L 21/08 285/305 |
| 2012/0111641 | A1* | 5/2012 | Ho | E21B 10/36 175/413 |

FOREIGN PATENT DOCUMENTS

| | | | |
|---|---|---|---|
| DE | 19 22 215 | A1 | 8/1971 |
| DE | 691 03 442 | T2 | 1/1995 |
| DE | 10106942 | A1 | 8/2001 |
| DE | 10 2004 032 551 | A1 | 1/2006 |
| EP | 3770375 | A1 | 1/2021 |
| WO | 2011/128045 | A2 | 10/2011 |

* cited by examiner

*Primary Examiner* — David Carroll
(74) *Attorney, Agent, or Firm* — Leason Ellis LLP

(57) ABSTRACT

A drill head of a ground drilling device includes a drill bit and an attachment which can be fastened to the drill bit, wherein at least one dowel pin is provided for holding the attachment on the drill bit, and the drill bit has one or more receptacles for a dowel pin, wherein the receptacle is enlarged with respect to the radius of the dowel pin.

6 Claims, 3 Drawing Sheets

DRILL BIT OF A GROUND DRILLING DEVICE WITH AN ENLARGEMENT OF A RECEPTACLE FOR FASTENING AN ATTACHMENT THERETO AND METHOD FOR PRODUCING SAME

The invention relates to a drill head of a ground drilling device having a drill bit and an attachment, to a method for producing a drill head of a ground drilling device, and to a use of a drill head of a ground drilling device.

Ground drilling devices in the form of ram drilling devices are known from the prior art and are used in particular for producing horizontal boreholes. Ram drilling devices are self-propelled drilling devices. As a rule, a ram drilling device of this type has an impact piston which is moved in an oscillating manner (back and forth) within a housing and in this case, depending on the desired direction of movement of the ram drilling device, impacts directly or indirectly on a front or rear impact surface of the housing. The kinetic energy of the impact piston that is transferred in this case ensures an acceleration of the ram drilling device within the ground.

WO 2011/128045 A2 discloses a ground drilling device which has a base body having a housing. An impact piston is movably mounted in the housing. As the impact piston moves forward, it hits the rear end of an impact bolt which is part of the drill head. The front end of the impact bolt forms a drill head tip which, due to the relatively small diameter thereof, ensures high directional stability of the ground drilling device which is designed as a ram drilling device or soil displacement hammer. Behind the (drill head) tip of the impact bolt, two ring-shaped drill head elements are connected to the impact bolt one behind the other. The connection is made by means of two fastening bolts in each case. The fastening bolts are dowel pins in corresponding bores that have a preload. In the case of these dowel pin bores, care must be taken to ensure that they are adapted to the radius of the dowel pin and that these dowel pin bores are aligned with one another. Although the type of fastening is stable, it can also be very complex to produce. Furthermore, the type of fastening makes interchangeability more difficult, since the exact dimensional accuracy of the drill head elements, which are connected to the impact bolt as attachments, and that of the impact bolt itself must be observed.

It is known to partially arrange receptacles in an impact bolt configured as a drill bit as well as to partially arrange receptacles in an attachment for a dowel pin in the drill bit and the attachment in such a way that they complement each other to form an overall receptacle for a dowel pin. The dowel pin can be inserted into an overall receptacle that results in this way. The receptacles for the drill bit and attachment are designed as round grooves which in turn are adapted to the radius of the dowel pin. Establishing a connection between the drill bit and the attachment is costly, complex, and can be susceptible to damage, since a defined preload (pressing on) of the attachment with respect to the drill bit must be achieved, and this with a flat cone angle of the drill bit.

Up to now, the view has been taken that extremely precise tolerances must be achieved in production. Even if there were only minor deviations in the dimensions of the attachment and drill bit, these were classified as rejects and not used any further. The production-related low tolerances affected both the position of the receptacles in the drill bit and the attachment and the design of the receptacle with the adaptation thereof to the radius of the dowel pin itself. Due to even small dimensional deviations in the diameter and/or drill bit and/or positions of the receptacles in the attachment and the receptacles in the drill bit, it was previously assumed that a larger offset between the attachment and the drill bit can result in a very large deformation of the dowel pin. The severely deformed dowel pin in turn has a strong effect, in particular on the receptacle in the drill bit, and drill bit fractures can occur—starting from the receptacle designed as a round groove.

The invention is now based on the object of creating a drill head of a ground drilling device, a method for producing a drill head of a ground drilling device, and a use of a drill head of a ground drilling device, so that the drill head can be improved with respect to the aforementioned disadvantages, in which in particular a simpler type of fastening of the attachment on the drill bit can be made possible. A simpler construction can be made possible. Longer service lives of the drill head may be possible.

This object is achieved by the subject matter of the independent claims. Advantageous embodiments are claimed in the dependent claims and result from the following description of the invention.

The core of the invention is to provide a modification in the receptacle of the dowel pin, contrary to the previous understanding of a person skilled in the art. The invention breaks with the idea of adapting the receptacle for the dowel pin in the drill bit with high precision in relation to the radius of the dowel pin used and thereby providing production with the lowest possible tolerances. The present invention thus takes a completely contrary approach to high-precision production with low tolerances in relation to the design of the receptacle in the drill bit for the dowel pin. The prejudice is broken in such a way that the design of the receptacle in the drill bit for the dowel pin is enlarged with respect to the design otherwise considered necessary. The core idea of the invention is based on the idea of providing a receptacle that is enlarged with respect to the diameter or radius of the dowel pin, which runs counter to the previous idea of providing narrow production tolerances with respect to the specification of the radius of the dowel pin. It was recognized for the first time that the service life can be improved despite an enlarged receptacle for the dowel pin, it also being possible for the attachment to be securely fastened to the drill bit despite the enlarged receptacle. Deviating from the round groove previously only considered for a receptacle, even a different shape than this round groove is possible.

The invention provides a drill head of a ground drilling device having a drill bit and an attachment which can be fastened to the drill bit, wherein at least one dowel pin is provided for holding the attachment on the drill bit, and the drill bit has one or more receptacles for a dowel pin, wherein the receptacle is enlarged with respect to the radius of the dowel pin.

In the context of the description, a "ground drilling device" comprises any device that can create or widen a borehole or is used to insert or introduce lines or other bodies into the ground. The ground drilling device can in particular have an impact piston and be moved intermittently in an existing duct or in a duct to be created in order to create or widen a bore or to replace or clean an existing pipe in a destructive or non-destructive manner, to introduce lines into existing pipes or other elongated bodies. The ground drilling device can in particular be a self-propelled impact device for creating a horizontal borehole, most preferably a ram drilling device or soil displacement hammer, with the terms "ram drilling device" and "soil displacement hammer" being used synonymously.

The term "ram drilling device" comprises both earth displacement devices in which the drill head tip or the drill bit is firmly connected to the housing, and ram drilling devices having a drill bit mounted so that it can be displaced axially with respect to the housing. A ram drilling device according to the invention can be either a one-stroke device or a two-stroke device. In a two-stroke device, the impact piston hits the drill bit first, which advances in the first stroke. In the second stroke, the housing is impacted by the impact piston. Tip drag and skin friction are separated in a two-stroke device and alternately more easily overcome. With a two-stroke device, there is better energy conversion, which in particular facilitates the smashing of obstacles as a result of the impact impulse being concentrated on the drill bit. As a result of the soil displacement that precedes the stroke distance of the drill head, the housing remains in a still position and thus ensures relatively good running stability.

A ground drilling device in the context of the invention is not limited to underground excavation works. For example, lines in which a ground drilling device or drill head can be operated can also run above ground.

The term "horizontal drilling" in the context of the description comprises in particular any type of, preferably horizontal, ducts existing or to be created in a body, in particular underground ducts including boreholes, rock bores, or underground lines as well as underground or above-ground pipelines and sewage ducts that can be created, widened, destroyed, cut open, cleaned or lined, and/or renovated by introducing a line or pipe using a corresponding ground drilling device.

The term "drill head" in the context of the description comprises a front end, in particular the frontmost end of the drill string of a ground drilling device. In particular, the drill head can have a housing or a part of a housing in which the impact piston hits the drill bit. The drill bit may be part of the drill head, with the tip of the drill bit usually forming the frontmost end of the drill string.

The term "drill bit" in the context of the description comprises an element of the drill string which is the first to contact the ground with the tip thereof. The drill bit can in particular be an impact bolt acted upon by an impact piston. The end acted upon by the impact piston can be the end which is at a distance from the tip of the drill bit. The drill bit can be present in a housing at the front end of the drill string or protrude from a housing at the front end of the drill string.

The term "attachment" in the context of the description comprises an attachment fitted on, in particular detachably connected to, the drill bit or the impact bolt, which attachment is arranged at least partially around the circumference of the drill bit. The radial extent of the attachment (outer contour) can substantially correspond to the radial extent (outer contour) of the housing. It can also be provided that the attachment extends radially (slightly) larger than the housing. The attachment can substantially have a conical shape. A design of an attachment with a cone tip is possible. The attachment can have one, two, or more cutting elements aligned radially and/or in the circumferential direction, so that the attachment can be configured as a crown head, as described in a two-part design in DE 10 2004 032 551 A1. An attachment designed as a crown head can also be designed in one piece. The attachment can preferably be designed as a stepped attachment or stepped head, as is described in DE 2 558 842 A1. Combinations and mixed forms of the aforementioned designs of the attachment(s) are possible, for example an attachment can have step-shaped cutting elements.

The attachment can be pushed from the outside onto the drill bit protruding from the housing at the front end of the drill string. The attachment may be outside of the housing with its outer face exposed. The attachment can have an inner face which corresponds to the outer face of the drill bit in the region of a bearing or support. In the region where the attachment rests on or against the drill bit, both the outer face of the drill bit and the inner face of the attachment can be designed to be conical. The attachment can be an attachment by means of which the drill bit can be changed in terms of the external shape and/or the function thereof when the attachment is fitted on. The drill bit can form a crown head and/or a stepped head with the attachment or a plurality of attachments or be converted into a drill head in the shape of a crown head and/or in the shape of a stepped head. The attachment can be fastened to the drill bit in a rotationally fixed manner.

The invention is described in particular with one attachment on a drill bit, but it is also possible to fasten to the drill bit a plurality of attachments, in particular two, arranged one behind the other in the longitudinal direction of the drill bit, for which purpose a plurality of receptacles arranged one behind the other in the longitudinal direction can be provided on the drill bit, which each may have an enlarged design within the meaning of the description. If a plurality of attachments can be provided on the drill bit, the plurality of attachments can have a different radial extent so that, for example, a front attachment (arranged closer to the drill bit tip) has a smaller diameter or a smaller radial extent than a rear attachment (at a farther distance from the drill bit tip). The rear attachment or rearmost attachment can have a radial extent that substantially corresponds to the radial extent of the housing, it also being possible for the radial extent of the rear or rearmost attachment to be (slightly) greater than the radial extent of the housing.

In the context of the description, a dowel pin or a dowel sleeve is understood to be an element which is used to fasten an attachment to a drill bit and is designed as a hollow, slotted pin or sleeve. The terms "dowel pin" and "dowel sleeve" can be used synonymously. To carry out the function of the dowel pin, it is usually at least partially or slightly compressed in a receptacle.

The term "receptacle" in the context of the description comprises a bore, recess, opening, hole, depression, groove, or the like, into which the dowel pin is inserted for the purpose of fastening the attachment to the drill bit, and the contour or limit thereof forms at least a portion of a contact surface for the dowel pin. In this case, the term "bore" does not primarily refer to the type of production, but to the mere provision of the recess, opening, hole, depression, or groove. The receptacle can be made using any machine tool, in particular a drill, a lathe, or a milling machine. The receptacle can be made with one or more rotating tools and the mechanical removal of chips or fragments. It is also possible to produce the receptacle by means of spark erosion, vibratory lapping, or by means of a laser. In a particularly preferred embodiment, the receptacle, in particular on the attachment, can be designed as a through-bore or through-hole.

To fasten an attachment to a drill bit, a receptacle can be provided into which a dowel pin can be inserted or introduced. A plurality of receptacles, each having a dowel pin, can be provided for each attachment. The drill bit and the attachment can thus form an overall receptacle or a plurality of overall receptacles for a dowel pin, in that the receptacle (s) in the attachment and drill bit can be aligned at least partially so that they overlap or are aligned.

A longitudinal axis of the receptacle can be aligned, at least in portions, transversely to the longitudinal direction of the drill bit or the attachment. The receptacle on the drill bit or on the attachment can run at least in portions in such a way that the longitudinal axis of the drill bit or of the attachment is not cut. Preferably, a receptacle on the drill bit can be designed as a bore or depression, which is formed at least over an angular portion of the circumference in a sectional plane to the longitudinal axis of the drill bit; a bore or depression (receptacle) may extend over the circumference of the drill bit, wherein the bore or depression (receptacle) may be formed at a level of the longitudinal axis of the drill bit. Particularly preferably, the receptacle on the drill bit can be designed as a depression which is formed on the circumference of the drill bit in a sectional plane transverse to the longitudinal axis of the drill bit. A portion of the depression on the drill bit can be designed as a depression in the form of a round groove. On the attachment, on the inside facing the drill bit, a receptacle for the dowel pin can be formed, which receptacle can be adapted to the position of a receptacle on the drill bit and together with a receptacle on the drill bit can form an "overall receptacle" for the dowel pin. A receptacle that is designed as a depression all the way around on the drill bit can form a plurality of "overall receptacles" for each dowel pin with a plurality of associated receptacles on the attachment. A portion of the dowel pin may be in contact with each of the associated drill bit and attachment receptacles in order to hold the attachment on the drill bit. On the one hand, the depth of the receptacle in the drill bit is selected in such a way that there is as little interference as possible on/in the drill bit, while, on the other hand, the depth is dimensioned sufficiently such that the receptacle together with the diameter of the dowel pin is sufficient to hold the attachment on the drill bit. The depth of the receptacle is generally in the range of 7% to 20% of the mean diameter of a receiving cone for the attachment or on the attachment, preferably in the range of 8% to 18% of the mean diameter of a receiving cone for the attachment or on the attachment, particularly preferably in the range from 9% to 16% of the mean diameter of a receiving cone for the attachment or on the attachment.

The receptacle on the drill bit can be designed as a depression which can run on the circumference of the drill bit along sectional planes which can contain the longitudinal axis of the drill bit, transversely to this sectional plane. The receptacle can preferably have substantially the same shape continuously over an angular circumference around the drill bit, in particular in the sectional plane. When the attachment is fitted on, the receptacle(s) on the attachment can be formed in the same and/or corresponding position relative to the longitudinal axis of the drill bit and form one or more overall receptacles through which a dowel pin can be pushed.

It can be provided that the receptacle for the dowel pin in the drill bit has a contact surface that is less than 120° of the circumference of the dowel pin, preferably less than 110° of the circumference of the dowel pin, in particular less than 100° of the circumference of the dowel pin. It can be provided that the receptacle for the dowel pin in the drill bit has a contact surface that is greater than 70°, in particular greater than 75°, in particular greater than 80°, in particular greater than 85°, in particular greater than 89°. It has been found that, although a small circumference of the dowel pin engages for receiving the drill bit, it still provides a suitable holding function for the attachment on the drill bit.

In a preferred embodiment, the predominant part of the dowel pin can be surrounded on the peripheral side by the receptacle in the attachment. A contact surface designed on the attachment for the dowel pin can be provided in the receptacle, which can cover an angular range of the dowel pin, which range is greater than 190°, in particular greater than 200°, in particular greater than 210°, in particular greater than 220°, in particular greater than 230°, in particular greater than 240°.

The core idea according to the invention can be expressed in that the dowel pin is present without contact over an angular range, i.e., without contact in the receptacle of the drill bit. The dowel pin can have an angular region on the circumference thereof that is present without contact for receiving the drill bit.

The depth of the receptacle in the drill bit can be made to be less than the wall thickness of the dowel pin. In particular, it can be provided that the overall receptacle, i.e., the receptacle of the drill bit for the dowel pin and the receptacle for the dowel pin on the attachment, are designed in depth transversely to a sectional plane that contains the longitudinal axis of the drill bit in such a way that the receptacle on the drill bit is less than a third of the diameter of the dowel pin, in particular a quarter of the diameter of the dowel pin, in particular a fifth of the diameter of the dowel pin, in depth or in height.

In a preferred embodiment, the receptacle has a contour having a first portion that is adapted to the radius of the dowel pin, wherein the contour of the receptacle has a further portion that has a design that is enlarged with respect to the first portion. The possibility can be provided of designing a receptacle in such a way that a plurality of regions of the receptacle are provided, with the receptacle being delimited by a contour which—corresponding to the plurality of regions—has different portions for the individual regions. Substantially, a region or portion of the contour can be provided which is adapted to the radius of the dowel pin and the other region allows an enlargement of the receptacle. In this way, the dowel pin can be given the opportunity to "relax" or not "compress completely" when it is loaded by a relative movement of the attachment to the drill bit, which means that the load on the dowel pin can be reduced.

If the shape or contour of the receptacle on the drill bit or on the attachment is considered, a shape or contour in a sectional plane of the drill bit and/or the attachment, which plane contains the longitudinal axis of the drill bit and/or the attachment, is preferably considered. In particular, sizes and/or positions may refer to the sectional plane of the drill bit and/or the attachment, which contains the longitudinal axis of the drill bit and/or the attachment.

It can be provided that the first portion is a portion that is adapted to a position of the dowel pin in the unloaded state of the attachment. The unloaded state of the attachment substantially corresponds to the state in which no external forces act on the attachment. In the event that no external forces act on the attachment, the attachment can substantially only be held on the drill bit. The first portion adapted to the unloaded state may be referred to as the "zero position" portion or a region of the "zero position" of the dowel pin. The position of the first portion and the shape or contour of the first portion can be adapted to the "zero position" for the drill bit and attachment. The ("zero position") portion or the first portion can be designed in such a way that the portion has a radius or a distance from a center position for the dowel pin which is adapted to the radius of the dowel pin in the substantially unloaded state. The first portion can be selected in such a way that the dowel pin is in line contact with the receptacle and this can also be the case in particular if there is a deviation from the planned theoretical zero position due to required tolerances (i.e., the attachment is already "offset" in the unloaded state with respect to the drill bit). If a dowel pin rests against the first portion, the dowel pin can at least be slightly compressed ("preloaded") in order to ensure the holding function. The first portion can be designed to be substantially two-dimensional and to comprise a surface which is formed along the radius and also extends transversely to the longitudinal axis of the drill bit. However, it can also be provided that the first portion is substantially linear, so that the two-dimensional design "can be reduced to one line" which can be a line of the aforementioned surface with the corresponding radius or distance from the center point for the dowel pin. The substantially linear design can substantially extend along the dowel pin or transversely to the longitudinal axis of the drill bit.

The term "contour" in the context of the description comprises the circumference or the limit of the receptacle or the cross section of the receptacle, which is characterized by the "absence" of material. To describe the contour, the (cross-sectional) shape can substantially be considered, which shape results from a cut transverse to the longitudinal direction of the receptacle or longitudinal direction of the drill bit or the attachment, wherein this cut can also or alternatively run transverse to the longitudinal extent of the dowel pin to be introduced into the receptacle. The contour of the receptacle does not necessarily have to be the same or identical over the entire longitudinal extent of the receptacle. A change in the contour in the direction of the longitudinal extent of the receptacle is possible. If a contour is described, this substantially means a contour that is present in the receptacle and can come into contact with the dowel pin at least in portions; a shape in the nearer edge region of the receptacle based on the edge of the attachment or the drill bit, with which the dowel pin cannot come into contact, is primarily independent thereof.

In the context of the description, the term "portion", in particular of the contour, comprises a region of the cross section of the receptacle or a region of the (cross-sectional) shape of the receptacle. The portion can extend over a region transverse to the longitudinal axis of the drill bit and transverse to the cross section of the receptacle or the (cross-sectional) shape.

In a preferred embodiment, the distance between a contour and the center point of the receptacle or a center point of a dowel pin to be inserted into the receptacle is smaller in a first portion than the distance of the contour in a further portion. As a result, a particularly simply designed geometry of the receptacle can be provided or produced by focusing on a center point of the receptacle or of the dowel pin to be inserted.

In the description of the preferred embodiments, the term "contour" or the term "portion" is first used for each of the preferred embodiments with the indefinite article and in the subsequent description of the preferred embodiment the definite article is used for the two terms. The indefinite article at the beginning of the description of a preferred embodiment expresses in this case that the different preferred embodiments do not have to be combined with regard to the design of the contour or the portions of the contour in order to represent a preferred embodiment. A preferred embodiment of a design of the contour or one of the portions of the contour, which follows a previously described design of the contour or portions of the contour in the description, does not have to be based on the design described previously, but rather can get by without the design described previously. Combinations of the designs described for the "contour" or the "portion(s)" are possible without restrictions, but each design of the contour or portions of the contour can represent a preferred embodiment on its own.

In a preferred embodiment, a first portion has a radius that is smaller than the radius of a further portion. As a result, a particularly simple design of an enlarged receptacle can be planned and also produced, for example by adapting the contour to the dowel pin in the first portion and by enlarging the receptacle in the further portion.

In a preferred embodiment, different portions of the contour of the receptacle are adjacent to one another, so that a receptacle that is easy to construct and is adapted to the dowel pin is possible.

In a preferred embodiment, an enlargement of the receptacle is present in a portion of the receptacle, which enlargement is arranged closer to the drill bit tip in the longitudinal direction of the drill bit. In particular, the portion having the enlargement of the receptacle can be a further portion described in the other embodiments. In this way, it can be achieved that, above all, the tolerances in the direction of the longitudinal axis of the drill bit and/or attachment are taken into account and the receptacle is enlarged in this direction.

In a preferred embodiment, an enlargement of the receptacle is designed as a straight line which is inclined in particular with respect to the longitudinal direction of the drill bit. The straight line can be part of a portion of a contour of the receptacle. The straight line can be part of the further portion of the other described embodiments. The straight line can be the further portion of the other described embodiments. In this way, a simple design of the enlargement of the receptacle can be achieved.

The straight line as a part of a portion of a contour of the receptacle can be arranged closer to the drill bit tip in the longitudinal direction of the drill bit than the first portion. The straight line can connect directly or indirectly to the first portion. Provision can be made for the receptacle to consist of the straight line and the first portion with a radius. The first portion with the radius, together with the inserted dowel pin, can specify a relative position of the drill bit to the attachment in which the attachment cannot be displaced any further in the direction pointing away from the drill bit tip. The first portion may be a limit surface for the dowel pin in a direction away from the drill bit tip. The straight line allows relative movement of the attachment and drill bit, during which the attachment can be pushed closer to the drill bit tip.

It can be provided that a receptacle having a portion designed as a straight line is designed in such a way that the attachment and the drill bit form an overall receptacle in which the dowel pin—in addition to possibly resting against the first portion—at least partially rests against the portion designed as a straight line in an unloaded position of the attachment ("zero position"), i.e., no external forces act on the attachment. A linear contact of the dowel pin in the receptacle can also be aimed at when the attachment is loaded, which results in a relative movement between the attachment and the drill bit, in which case the attachment can move in the direction of the drill bit tip.

In a preferred embodiment, the inclination of the straight lines that may be present in a contour, with respect to the longitudinal direction of the drill bit or the attachment, has an angle of between 5° and 20°, in particular between 10° and 20°, in particular between 12° and 18°, in particular between 14° and 18°. The design of the values mentioned is easily achievable and manageable for production and planning by the persons entrusted therewith. The inclination can increase with respect to the drill bit tip.

In a preferred embodiment, an enlargement of the receptacle can be present in a portion of the receptacle, which enlargement is at a farther distance from the drill bit tip in the longitudinal direction of the drill bit than one or more other possible portions of the receptacle. In particular, the portion having the enlargement of the receptacle can be a further portion described in the other embodiments. In this way, it can be achieved that even in a possible relative direction of movement of the attachment on the drill bit "to the rear" or away from the drill bit tip, relaxation or relief of the dowel pin can be present or achieved. A notch effect that possibly occurs can be reduced.

The invention also provides a method for producing a drill head of a ground drilling device, the drill head having a drill bit and an attachment. The attachment can be fastened to the drill bit. The attachment can be held on the drill bit by means of at least one dowel pin, and the drill bit has one or more receptacles for the dowel pin, the receptacle being enlarged with respect to the radius of the dowel pin.

The invention also provides a use of a drill head of a ground drilling device, the drill head having a drill bit and an attachment which can be fastened to the drill bit. A dowel pin is used to hold the attachment on the drill bit. The drill bit has one or more receptacles for the dowel pin, wherein a design of the receptacle is used, which design is enlarged with respect to the radius of the dowel pin.

The invention is described with regard to a drill head, to a method for producing a drill head, and to a use of a drill head. The description of each of the three aspects mentioned complement each other, so that in particular the description of the drill head can also be used to describe the method for producing the drill head and/or the use of a drill head of a ground drilling device. The aspects complement each other and can be freely exchanged, supplemented, and/or used with regard to their formal design of device features, method features, and use features.

The term "transverse" as a directional statement or geometric statement relative to a further direction comprises an angle of 90°, but also deviations from this, in order to take account of tolerances in the production of the components in particular. The statement "transverse" comprises an angle included with the reference direction in the range of about 5° to 175°, preferably between about 20° and about 160°, more preferably between about 35° and about 145°, particularly preferably between about 50° and about 130°, most preferably between about 65° and about 115°, most preferably between about 70° and about 110°, most preferably between about 80° and about 100°, most preferably between about 95° and about 95°.

If a numerical specification is used in the description and/or the claims, this numerical specification not only comprises the pure value itself, but also a range specification of an interval with marginal values that result from the pure value+/−10%, in particular +/−5%.

Like the following description of embodiments, the above statements do not constitute a waiver of specific embodiments or features.

The invention is explained in more detail below with reference to an embodiment shown in the drawings in which.

Figure 1:
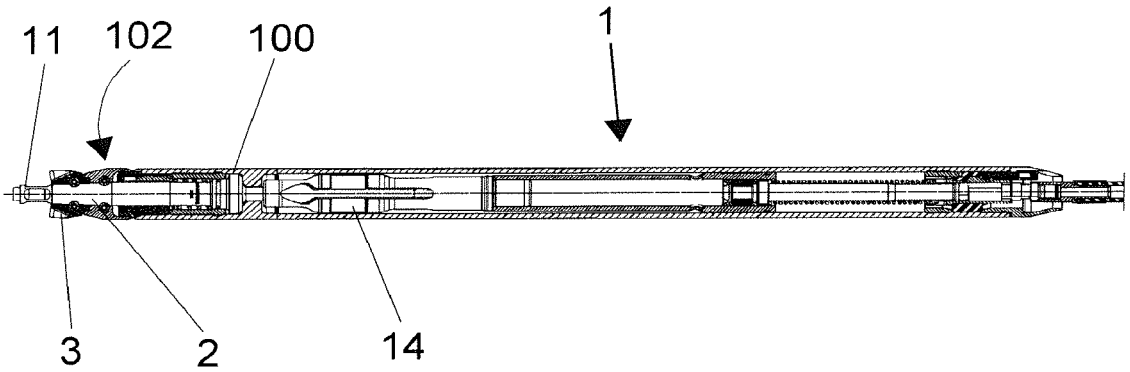
FIG. 1 is a sectional view of a ground drilling device.

FIG. 1 shows an example of a ground drilling device 1 which is designed as a self-propelled impact device. A drill bit 2, which is part of a drill head 102, protrudes from a housing 100. The drill bit 2 has a drill bit tip 11. In the housing 100, the drill bit 2 can be acted upon at the end side by means of an impact piston 14 moving back and forth in the housing 100. The impact piston hits the end which is at a distance from the drill bit tip 11 in a pulsed manner.

The drill head 102 has the drill bit 2 and an attachment 3 fastened to the drill bit 2.

Figure 2:
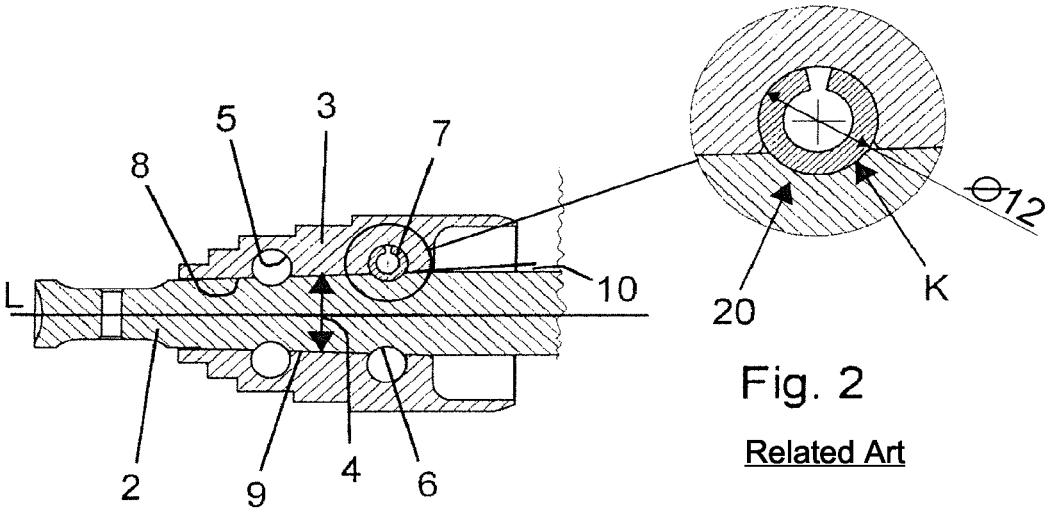
Fig. 2 Related Art
FIG. 2 is an enlarged view of the fastening of an attachment to a drill bit according to the prior art with a further enlarged view in the region of a receptacle for a dowel pin.

FIG. 2 is an enlarged view of the fastening of the attachment 3 on the drill bit 2, as previously done: The attachment 3 has a conical (central) bore 8 with which the attachment 3 is pressed onto the drill bit 2 which has a conical outer face 9. The conical contact surfaces of the bore 8 and the outer face 9 are adapted to each other. The connection is secured by means of a plurality of dowel pins 7 (four are selected in the embodiment shown) under a defined preload which braces the attachment 3 against the drill bit 2. In the prior art, as shown in FIG. 2, very narrow tolerances have to be observed. This applies to the cone angle 10 and a cone diameter 4 of the attachment 3 and the drill bit 2, as well as to the positions of receptacles or bores 5 for the dowel pin in the attachment 3 and of receptacles or round grooves 6 on the drill bit 2 in the direction of the longitudinal axis L of the drill bit 2 or of the attachment 3. Compliance with the tolerances served to achieve a defined preload between the attachment 3 and the drill bit 2. The entire contour of the receptacle 6 is adapted to the diameter of the dowel pin 7; the contour K of the receptacle 6 is formed in its the entirety by means of one and the same portion 20 which, as a radius portion, is adapted to the diameter of the dowel pin 7.

Figure 3:
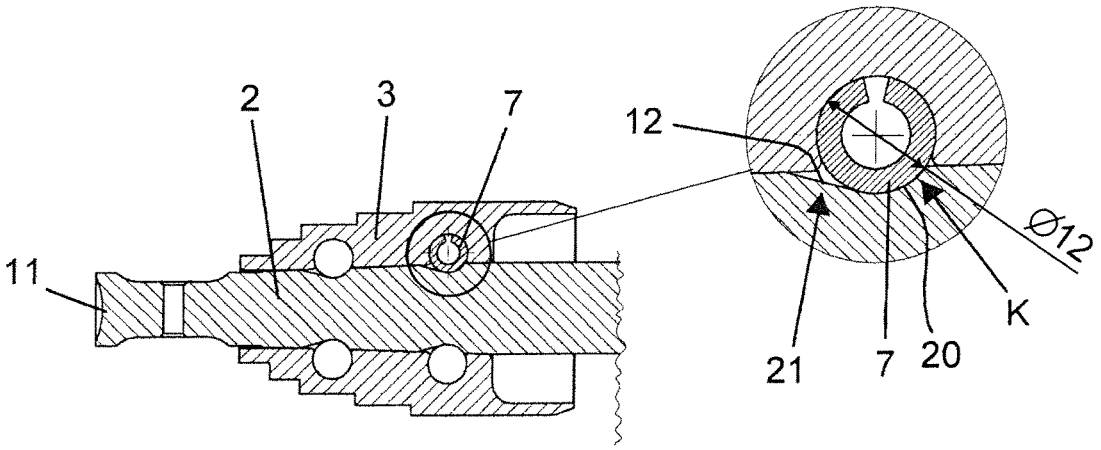
FIG. 3 is an enlarged view of the fastening of an attachment to a drill bit with an enlarged receptacle in contrast to FIG. 2.

FIG. 3 shows a preferred embodiment of a design of the receptacle 6 now provided on the drill bit 2: The attachment 3 is in this case in a marginal (extreme) position on the drill bit 2; the dowel pins 7 create a preload between the attachment 3 and the drill bit 2. The attachment 3 is shown in an unloaded state, i.e., free from external forces. The receptacles 6 on the drill bit 2 have a portion 20 having a contour K (adapted or suitable radius) adapted to the dowel pin 7. In addition, there is another portion 21 of the contour K of the receptacle 6, which portion is designed as a straight line 12 that rises toward the drill bit tip 11 (in this case at an angle of 16° to the longitudinal axis L of the drill bit 2).

Figure 4:
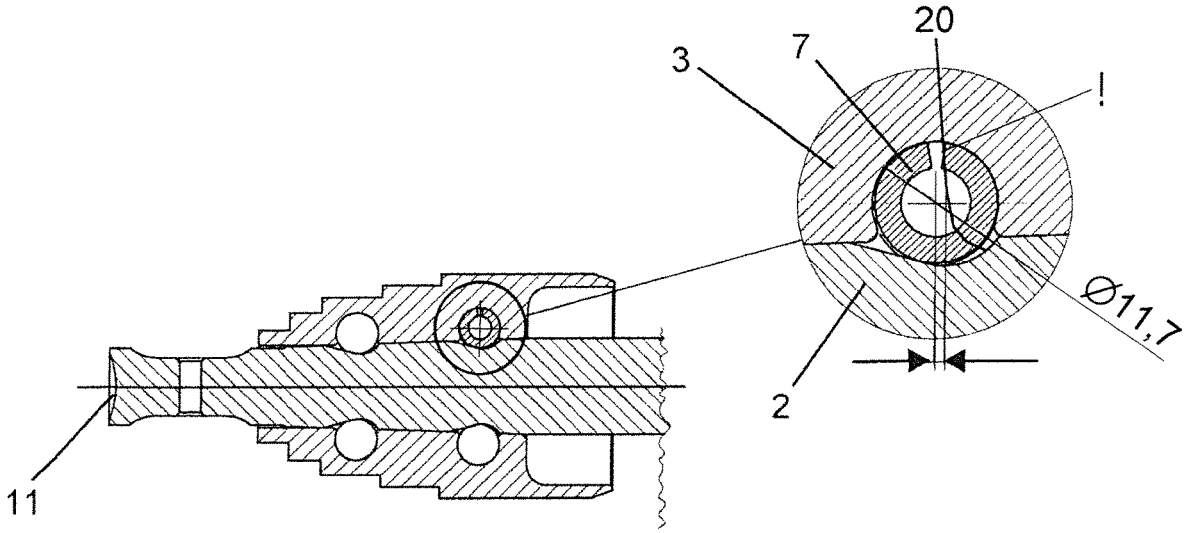
FIG. 4 shows the attachment fastened to the drill bit of FIG. 3 after relative movement of the attachment with respect to the drill bit.
Figure 5:
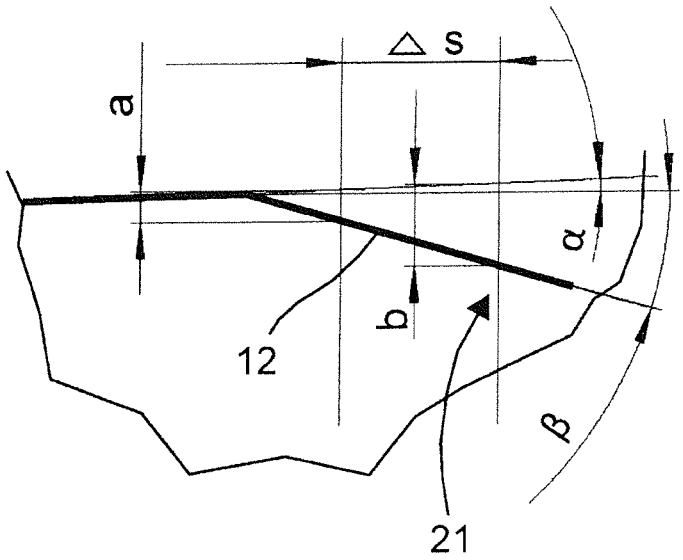
FIG. 5 is an enlarged view in the front-side region of the receptacle of FIGS. 3 and 4.

FIGS. 4 and 5 describe the connection between a possible displacement ΔS and the resulting diameter difference ΔD for the dowel pin 7 in the event that the front-side portion 21 causing the enlargement of the receptacle 6 is designed as a straight line 12:

$$\Delta D = b - a = \Delta S \times (\tan \alpha + \tan \beta)$$

For example, a displacement of the dowel pin 7 in the direction of the drill bit tip of ΔS=1 mm and a possible cone angle 10 of the attachment 3 and the drill bit 2 of α=2° and an angle of the straight line 12 of the contour K of the receptacle 6 of β=16° results in a diameter difference of the dowel pin 7 in the amount of ΔD=1 mm×(tan 2°+tan 16°)=0.32 mm. It can be seen from FIG. 4 that a displacement of the attachment 3 is possible by 1 mm without the dowel pin 7 being fully compressed. A further displacement of the attachment 3 in the direction of the drill bit tip is readily possible with regard to a compression of the dowel pin 7.

Figure 6:
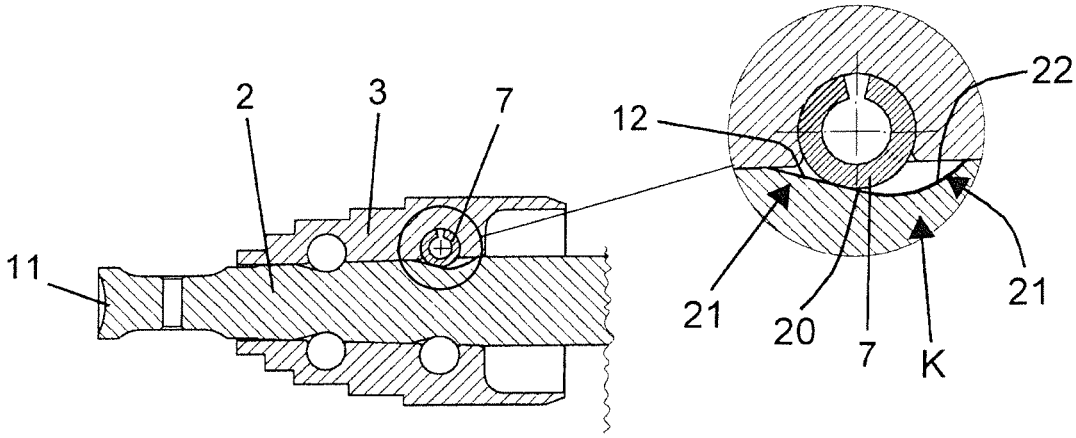
FIG. 6 is a further embodiment with an enlarged receptacle in contrast to FIG. 2.

FIG. 6 shows a further preferred embodiment of a design of the receptacle 6 on the drill bit 2: The attachment 3 is in an unloaded state on the drill bit 2, i.e., free from external forces, similar to the situation according to FIG. 3. The contour K of the receptacle 6 on the drill bit 2 has the portion 20 which is adapted to the dowel pin 7. In addition, there are two further portions 21 of the contour K of the receptacle 6, with which portions the receptacle 7 is designed to be enlarged. In addition to the straight line 12, a portion 22 is designed at a distance from the drill bit tip, which portion has a larger radius than the radius of the portion 20 adapted to the dowel pin 7.

The invention claimed is:

1. A drill bit of a ground drilling device that is a ram drilling device, the drill bit being adapted to receive an attachment fastened to the drill bit, the drill bit comprising:

a drill bit receptacle, wherein the attachment comprises an attachment receptacle and each of the drill bit receptacle and the attachment receptacle extends transversely to a longitudinal direction of the drill bit and the attachment, respectively, for inserting a dowel pin to fasten the attachment to the drill bit; and an enlargement of the drill bit receptacle with respect to a radius of the dowel pin, wherein the enlargement of the drill bit receptacle is in a straight line that is inclined with respect to the longitudinal direction of the drill bit by an angle between 5° and 20°.

2. The drill bit according to claim 1, wherein a first distance between a first portion of a contour of the drill bit receptacle and a center point of the drill bit receptacle is smaller than a second distance between the contour of the drill bit receptacle in a further portion and said center point.

3. The drill bit according to claim 1, wherein the drill bit receptacle has a first radius in a first portion, which first radius is smaller than a second radius of a further portion.

4. The drill bit according to claim 1, wherein the enlargement of the drill bit receptacle is present in a portion of the drill bit receptacle that is arranged in the longitudinal direction of the drill bit closer to a drill bit tip.

5. A method for producing a drill bit of a ground drilling device that is a ram drilling device, comprising:

providing the drill bit with a drill bit receptacle, the drill bit being adapted to receive an attachment fastened to the drill bit, wherein the attachment is fastened to the drill bit by means of at least one dowel pin inserted into the drill bit receptacle and an attachment receptacle of the attachment; and providing an enlargement of the drill bit receptacle with respect to a radius of the dowel pin, wherein the enlargement of the drill bit receptacle is in a straight line that is inclined with respect to a longitudinal direction of the drill bit by an angle between 5° and 20°.

6. A ground drilling device that is a ram drilling device, comprising:

a drill bit having a drill bit receptacle; and an attachment fastened to the drill bit, said attachment having an attachment receptacle, wherein the attachment is fastened to the drill bit by means of at least one dowel pin inserted into the drill bit receptacle and the attachment receptacle, wherein the drill bit receptacle is enlarged with respect to a radius of the dowel pin, and wherein the enlargement of the drill bit receptacle is a straight line that is inclined with respect to a longitudinal direction of the drill bit by an angle between 5° and 20°.

* * * * *